US011305172B2

(12) United States Patent
Coffman

(10) Patent No.: US 11,305,172 B2
(45) **Date of Patent: *Apr. 19, 2022**

(54) GOLF SIMULATION SYSTEM

(71) Applicant: Full-Swing Golf, Inc., Carlsbad, CA (US)

(72) Inventor: Sean Coffman, Beresford, SD (US)

(73) Assignee: Full-Swing Golf, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/804,599

(22) Filed: Feb. 28, 2020

(65) Prior Publication Data

US 2020/0197778 A1 Jun. 25, 2020

Related U.S. Application Data

(63) Continuation of application No. 16/102,085, filed on Aug. 13, 2018, now Pat. No. 10,596,442, which is a continuation of application No. 14/709,834, filed on May 12, 2015, now Pat. No. 10,058,758, which is a continuation of application No. 14/093,963, filed on Dec. 2, 2013, now Pat. No. 9,028,335, which is a continuation of application No. 13/917,896, filed on Jun. 14, 2013, now Pat. No. 8,616,988.

(51) Int. Cl.

| | |
|---|---|
| ***A63B 69/36*** | (2006.01) |
| ***A63B 71/06*** | (2006.01) |
| ***A63B 24/00*** | (2006.01) |
| *A63B 102/32* | (2015.01) |

(52) U.S. Cl.

CPC ..... *A63B 69/3661* (2013.01); *A63B 24/0003* (2013.01); *A63B 69/36* (2013.01); *A63B 69/3676* (2013.01); *A63B 71/0622* (2013.01); *A63B 2024/0028* (2013.01); *A63B 2102/32* (2015.10); *A63B 2225/09* (2013.01)

(58) Field of Classification Search

CPC ..... A63B 69/3661; A63B 69/3676; A63B 71/0622; A63B 24/0003; A63B 69/36; A63B 2102/32; A63B 2024/0028; A63B 2225/09

USPC ..... 473/150, 157–163, 171, 278, 279

See application file for complete search history.

(56) References Cited

U.S. PATENT DOCUMENTS

| | | | | |
|---|---|---|---|---|
| 1,080,972 | A | | 12/1913 | Jackson |
| 1,612,291 | A | * | 12/1926 | Jackson ..... A63B 67/02 473/160 |
| 1,612,292 | A | | 12/1926 | Jackson |
| 2,678,823 | A | | 5/1954 | Hugman |
| 3,170,694 | A | | 2/1965 | Dolce |
| 3,595,581 | A | | 7/1971 | Anderson et al. |
| 3,601,406 | A | | 8/1971 | Giusti |

(Continued)

*Primary Examiner* — Nini F Legesse

(74) *Attorney, Agent, or Firm* — Veros Legal Solutions, LLP

(57) ABSTRACT

A green simulation apparatus may comprise a covering forming a configurable upper surface with a changeable contour and being flexible such that the covering is movable between a base condition in which the upper surface has a substantially planar configuration and a contoured condition in which the upper surface has a contoured configuration. The apparatus may also comprise a covering support assembly configured to support the covering in the base condition and the contoured condition.

15 Claims, 11 Drawing Sheets

(56) References Cited

U.S. PATENT DOCUMENTS

| | | | | | |
|---|---|---|---|---|---|
| 3,658,343 | A | | 4/1972 | Rogers et al. | |
| 3,892,412 | A | | 7/1975 | Koo | |
| 4,009,881 | A | | 3/1977 | Potter | |
| 4,160,942 | A | | 7/1979 | Lynch et al. | |
| 4,222,568 | A | | 9/1980 | Russo | |
| 4,611,809 | A | | 9/1986 | Gettelfinger | |
| 4,749,169 | A | | 6/1988 | Pickles | |
| 4,790,538 | A | | 12/1988 | Gettelfinger | |
| 4,943,034 | A | | 7/1990 | Wagnon | |
| 5,031,916 | A | | 7/1991 | Boswell | |
| 5,056,791 | A | * | 10/1991 | Poillon | A63B 69/3658 473/156 |
| 5,087,045 | A | | 2/1992 | Kim | |
| 5,094,569 | A | | 3/1992 | Fleming | |
| 5,100,145 | A | | 3/1992 | Kim | |
| 5,172,914 | A | | 12/1992 | Primerano | |
| 5,221,082 | A | | 6/1993 | Curshod | |
| 5,333,874 | A | * | 8/1994 | Arnold | A63B 24/0021 473/156 |
| 5,390,926 | A | | 2/1995 | Hanson et al. | |
| 5,390,927 | A | | 2/1995 | Angelos | |
| 5,657,964 | A | | 8/1997 | Yoshida | |
| 5,855,522 | A | | 1/1999 | Bevan | |
| 5,950,990 | A | | 9/1999 | Castillo | |
| 6,056,645 | A | | 5/2000 | Servatius | |
| 6,179,721 | B1 | | 1/2001 | Bevan | |
| 6,338,682 | B1 | | 1/2002 | Torchia et al. | |
| 6,695,289 | B1 | | 2/2004 | Mickael | |
| 6,746,338 | B1 | | 6/2004 | Keaton | |
| 6,769,993 | B1 | | 8/2004 | Lasalandra | |
| 6,805,638 | B2 | | 10/2004 | Chang | |
| 6,913,541 | B2 | | 7/2005 | Chen | |
| 6,964,615 | B2 | | 11/2005 | Lee | |
| 8,616,988 | B1 | * | 12/2013 | Coffman | A63B 69/3676 473/150 |
| 9,028,335 | B1 | | 5/2015 | Coffman | |
| 9,308,429 | B1 | | 4/2016 | Coffman | |
| 9,731,183 | B2 | | 8/2017 | Coffman | |
| 9,987,542 | B2 | * | 6/2018 | Coffman | A63B 69/3661 |
| 9,987,543 | B2 | * | 6/2018 | Coffman | A63B 69/3661 |
| 9,993,713 | B2 | * | 6/2018 | Coffman | A63B 69/3661 |
| 10,137,351 | B2 | * | 11/2018 | Coffman | A63B 69/3676 |
| 10,486,047 | B2 | * | 11/2019 | Coffman | A63B 69/3661 |
| 2001/0003103 | A1 | | 6/2001 | Bevan | |
| 2005/0153788 | A1 | | 7/2005 | Saldana | |
| 2011/0192096 | A1 | | 8/2011 | Koberinski et al. | |
| 2014/0073445 | A1 | * | 3/2014 | Flammer | A63B 69/3676 473/161 |
| 2015/0231479 | A1 | | 8/2015 | Coffman et al. | |

* cited by examiner

GOLF SIMULATION SYSTEM

RELATED APPLICATIONS

This application is a continuation of U.S. application Ser. No. 16/102,085, which is a continuation of U.S. application Ser. No. 14/709,834, now U.S. patent Ser. No. 10/058,758, which is a continuation of U.S. application Ser. No. 14/093,963, now U.S. Pat. No. 9,028,335, which is a continuation of U.S. application Ser. No. 13/917,896, now U.S. Pat. No. 8,616,988. The entire disclosures of all the related applications set forth in this section are hereby incorporated by reference in their entireties.

BACKGROUND

The present disclosure relates to golf simulation apparatus and more particularly pertains to a new golf simulation system for providing a more realistic and challenging contouring of the surface of a simulated green surface.

It should be noted that this Background is not intended to be an aid in determining the scope of the claimed subject matter nor be viewed as limiting the claimed subject matter to implementations that solve any or all of the disadvantages or problems presented above. The discussion of any technology, documents, or references in this Background section should not be interpreted as an admission that the material described is prior art to any of the subject matter claimed herein.

SUMMARY

In one aspect, the present disclosure relates to an apparatus having a configurable upper surface with a changeable contour. The apparatus may comprise a covering forming the upper surface, the covering being flexible such that the covering is movable between a base condition in which the upper surface has a substantially planar configuration and a contoured condition in which the upper surface has a contoured configuration. The apparatus may also comprise a covering support assembly configured to support the covering in the base condition and the contoured condition. The support assembly may comprise a plurality of movable positioning elements having the covering resting thereon, with the plurality of positioning elements being positioned in an array below the covering and each having an upper end contacting a portion of the covering. The positioning elements are movable to adjust a vertical position of the upper end of the positioning element contacting the covering. The support assembly may also include a movement actuator configured to move at least one of the positioning elements, with one of the movement actuators acting on at least one of the positioning elements such that the positioning elements are movable independently of other positioning elements.

In another aspect, the present disclosure relates to a golf simulation system may comprise a screen with a projection surface, a ball path analysis device configured to predict a path of a ball struck by a club of a user, and a green simulation apparatus having a configurable upper surface with a changeable contour. The apparatus may comprise a covering forming the upper surface and being flexible such that the covering is movable between a base condition in which the upper surface has a substantially planar configuration and a contoured condition in which the upper surface has a contoured configuration. The apparatus may also comprise a covering support assembly configured to support the covering in the base condition and the contoured condition.

The support assembly may comprise a plurality of movable positioning elements having the covering resting thereon, and the plurality of positioning elements may be positioned in an array below the covering. The positioning elements may each have an upper end contacting a portion of the covering, and the positioning elements may be movable to adjust a vertical position of the upper end of the positioning element contacting the covering. The support assembly may also comprise a movement actuator configured to move at least one of the positioning elements, with one of the movement actuators acting on one of the positioning elements such that each of the positioning elements is movable independently of other positioning elements. There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

It is understood that various configurations of the subject technology will become apparent to those skilled in the art from the disclosure, wherein various configurations of the subject technology are shown and described by way of illustration. As will be realized, the subject technology is capable of other and different configurations and its several details are capable of modification in various other respects, all without departing from the scope of the subject technology. Accordingly, the summary, drawings and detailed description are to be regarded as illustrative in nature and not as restrictive.

BRIEF DESCRIPTION OF THE DRAWINGS

Various embodiments are discussed in detail in conjunction with the Figures described below, with an emphasis on highlighting the advantageous features. These embodiments are for illustrative purposes only and any scale that may be illustrated therein does not limit the scope of the technology disclosed. These drawings include the following figures, in which like numerals indicate like parts.

DETAILED DESCRIPTION

Figure 1:
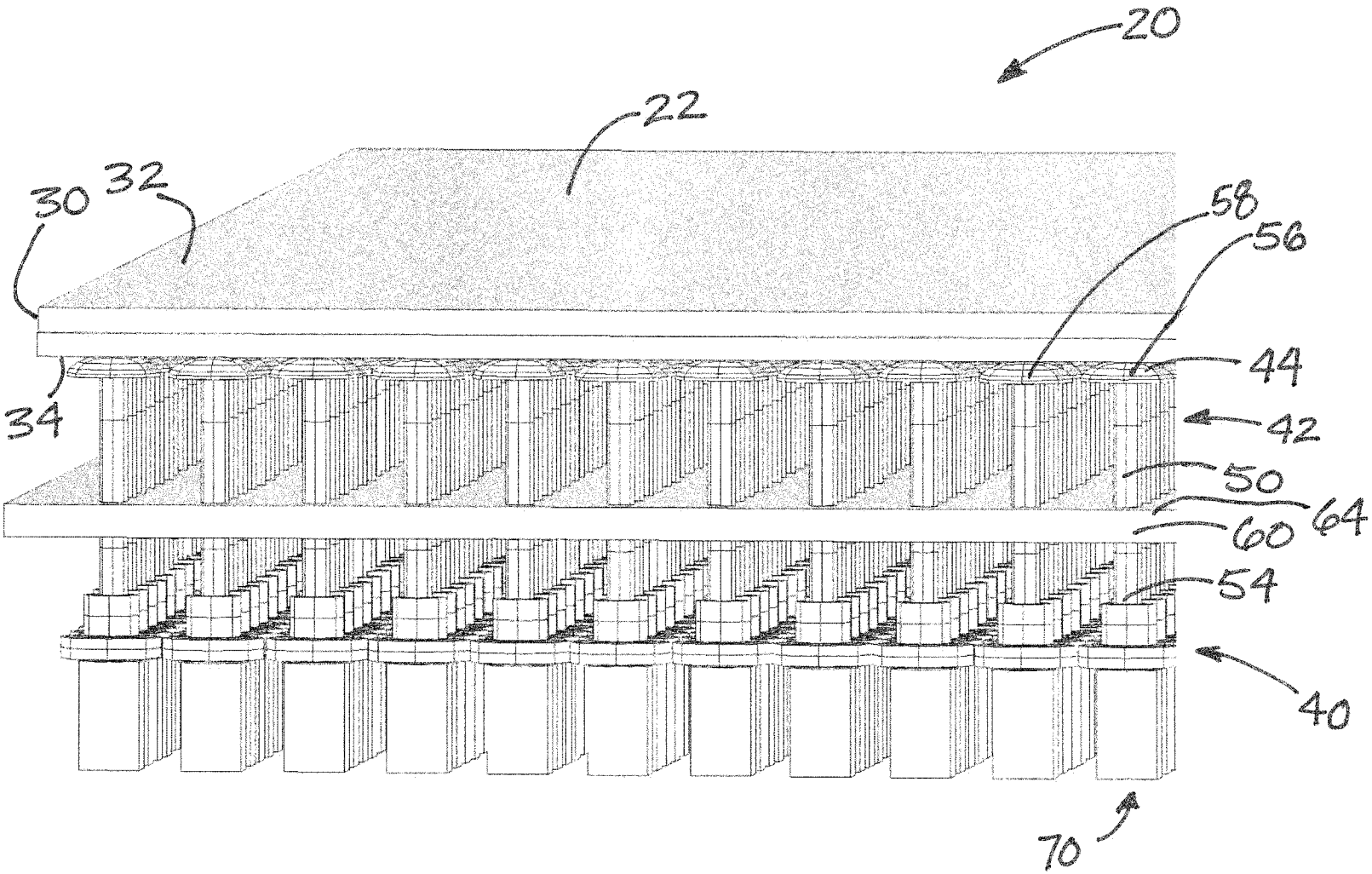
FIG. 1 is a schematic perspective view of the green simulation apparatus of a new golf simulation system according to the present disclosure, with the covering in a base condition and the support assembly in a neutral position.
Figure 2:
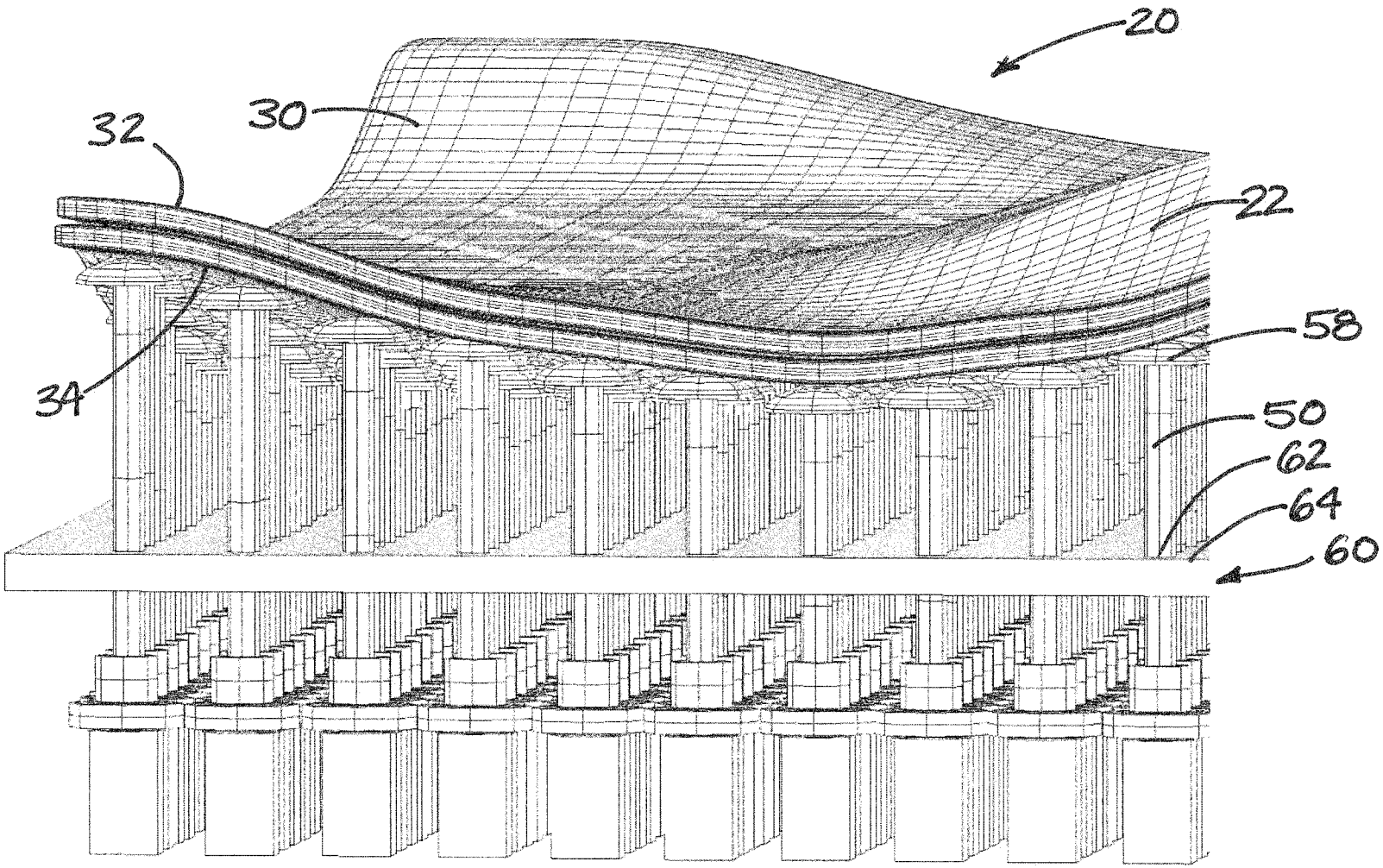
FIG. 2 is a schematic perspective view of the simulation apparatus with the covering in a contoured condition and the support assembly in a raised position.
Figure 3:
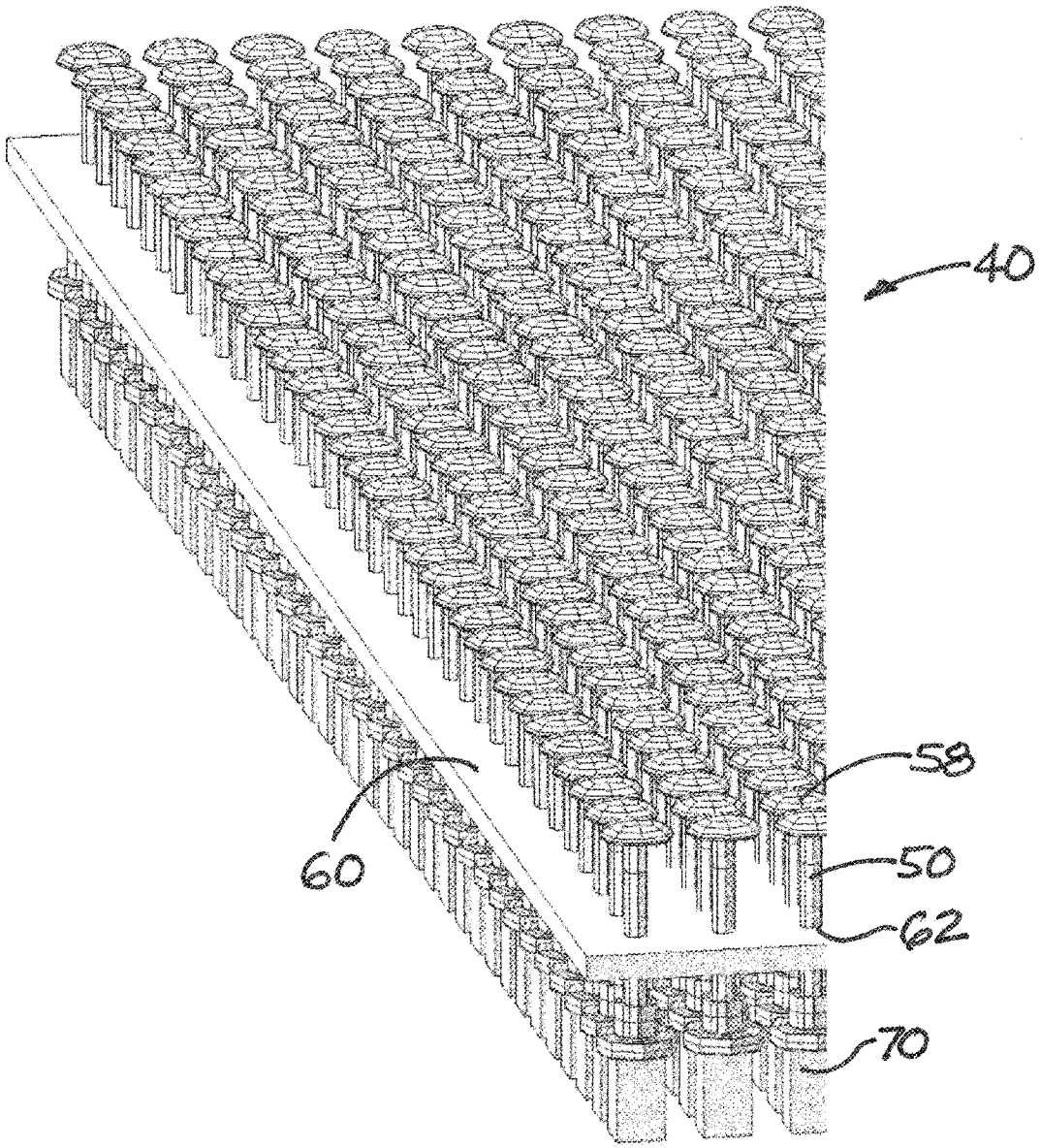
FIG. 3 is a schematic perspective view of the support assembly with the covering removed to show detail of the positioning elements, the guide and the movement actuators in the neutral position.
Figure 4:
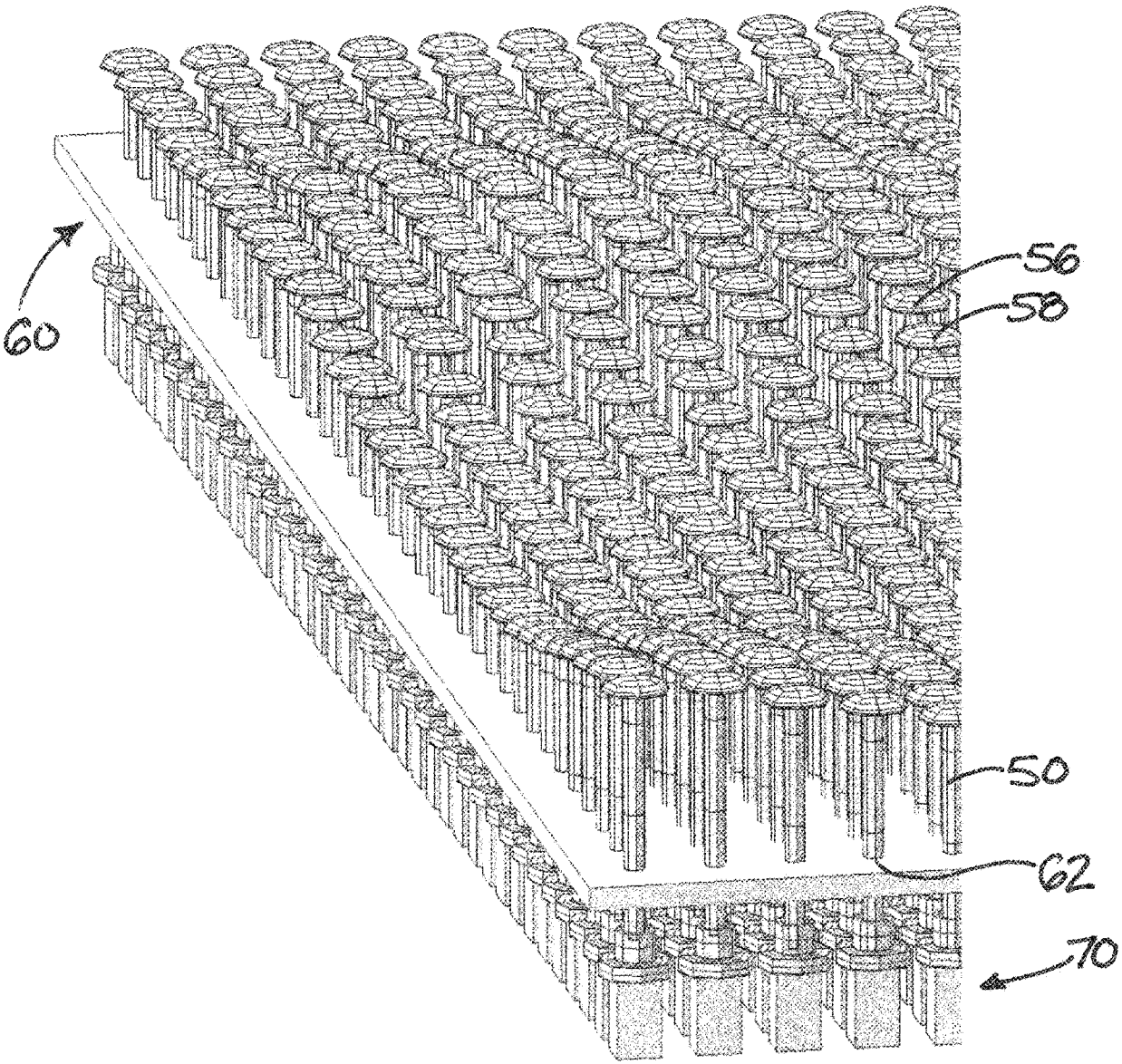
FIG. 4 is a schematic perspective view of the support assembly with the covering removed to show detail of the positioning elements, the guide and the movement actuators in the raised position.

The following description and examples illustrate some exemplary implementations, embodiments, and arrangements of the disclosed invention in detail. Those of skill in the art will recognize that there are numerous variations and modifications of this invention that are encompassed by its scope. Accordingly, the description of a certain example embodiment should not be deemed to limit the scope of the present invention.

With reference now to the drawings, and in particular to FIGS. 1 through 10 thereof, a new golf simulation system embodying the principles and concepts of the disclosed subject matter will be described.

Applicant has recognized the value of devices that provide a virtual experience that is close to the actual experience. One example is a golf simulation system that allows the user to practice his or her golf swing in a controlled environment that provides a screen on which an image of a golf course fairway is projected for the purpose of the user lining up a shot and taking the shot, with the system providing some indication of the movement of the ball after the swing has been taken and the ball has been struck. Typically, these simulators utilize a path of simulated turf large enough only for the user to stand and address the ball in a normal golf stance.

Applicant has also recognized that the value of such conventional simulators for short game practice, especially putting, is very limited. Typically, putting practice has been conducted on the floor of a room or platform which presents a flat, level, and not very realistic environment for practice. Golf course greens are typically not completely flat and level, particularly if the course is intended to be challenging to the player.

Applicant has developed a system that may be used to realistically simulate golf greens with a variety of changeable contours to provide a more realistic and challenging practice experience, and which may be used with more conventional golf simulators which only attempt to simulate the long game.

Broadly, the aspects of the disclosure may be used to contour a surface such as a surface located on a support or platform in a manner that is easily and quickly changeable from one contour to another contour. The contouring may be produced and reproduced from contour data that has been generated from actual landscapes or may be created with no real antecedent landscape basis for the contour In one aspect of the development, a golf simulation system 10 comprises a screen 12 that may have a projection surface 14 onto which various golf course representations may be projected. The projection surface 14 of the screen may be substantially vertically oriented and may be curved to extend about the user to some degree. The system 10 may also include a ball path analysis device 16 that uses various parameters such as club path, club speed, ball spin, etc. to determine a path for movement of the image of a simulated ball on the projection screen. The particular technology used to determine ball path and other aspects of the long game is not critical to the system and is known to those skilled in the art and will not be further discussed here.

Another aspect of the disclosure is a green simulation apparatus 20 that may be used with the aforementioned elements of the system 10. Significantly, the green simulation apparatus 20 has a configurable upper surface 22 that is moveable to provide a changeable contour. The configurable upper surface 22 may have a periphery 24, and the periphery may have opposite lateral sides 26, 27 and opposite ends 28, 29.

In some embodiments, the periphery 24 of the upper surface may be surrounded by a frame having a stationary upper surface. In general, the apparatus may include a covering 30 that may extend between the sides 26, 27 and ends 28, 29 and a covering support assembly 40 that supports the cover and also causes the contouring of the covering. The covering may be continuous between the sides and ends or may comprise pieces that are mounted on one or more of the movable positioning elements 42 of the support assembly 40.

The covering 30 may form the upper surface 22 of the apparatus 20. The covering 30 may have a base condition (see FIG. 1 in which the upper surface 22 has a substantially planar or flat configuration and may also be level, which may represent a flat and level green surface. The covering may also have a contoured condition (see FIG. 2) in which the upper surface has a contoured configuration including portions of the surface that slope with peaks or ridges and valleys to simulate a green surface without an entirely flat and level orientation.

The covering 30 may have an upwardly oriented top face 32 which forms the upper surface 22. The top face may be substantially continuous in character between the sides 26, 27 and ends 28, 29 of the periphery. The top face may also be configured in a manner that simulates the surface of a golf green, such as by the inclusion of a simulated turf material, although this is not critical to the system 10. The covering 30 may also have a bottom face positioned opposite of the top face and oriented downwardly.

Significantly, the covering 30 may be flexible, and may also be stretchable. The material forming the covering may be relatively incapable of supporting the weight of a user absent the covering support assembly described below. Materials having elastomeric properties may be highly suitable.

The covering support assembly 40 may support the covering in the various conditions, such as the base condition and the contoured condition. As the covering may not have any natural shape, or only a flat shape, the support assembly may form contours in the upper surface of the covering by varying the vertical level of support provided to different portions of the covering.

The support assembly 40 may comprise a plurality of movable positioning elements 42 that have the covering resting thereon such that the elements may control the vertical position of the portion of the covering that is located above the element. The plurality of positioning elements may be positioned in an array, and the army may have each of the positioning elements 42 positioned in a first line and a second line. In some embodiments, the first and second lines may be substantially perpendicular to each other (see FIG. 3}, and in other embodiments the first and second lines may be at an oblique angle with respect to each other (see FIG. 7).

The positioning elements 42 may each have an upper end 44 for contacting a portion of the covering for moving the covering a generally upward and downward direction. The positioning elements 42 may be substantially vertically movable to adjust the position of the upper end and thereby the position of the portion of the covering 30 having contacted by the upper end 44. The positioning elements 42 may be elongated in shape with a longitudinal axis 46, which may be substantially vertically oriented. The upper ends 44 may be moveable with respect to a reference plane, represented by reference number 48 in FIG. 5.

Figure 5:
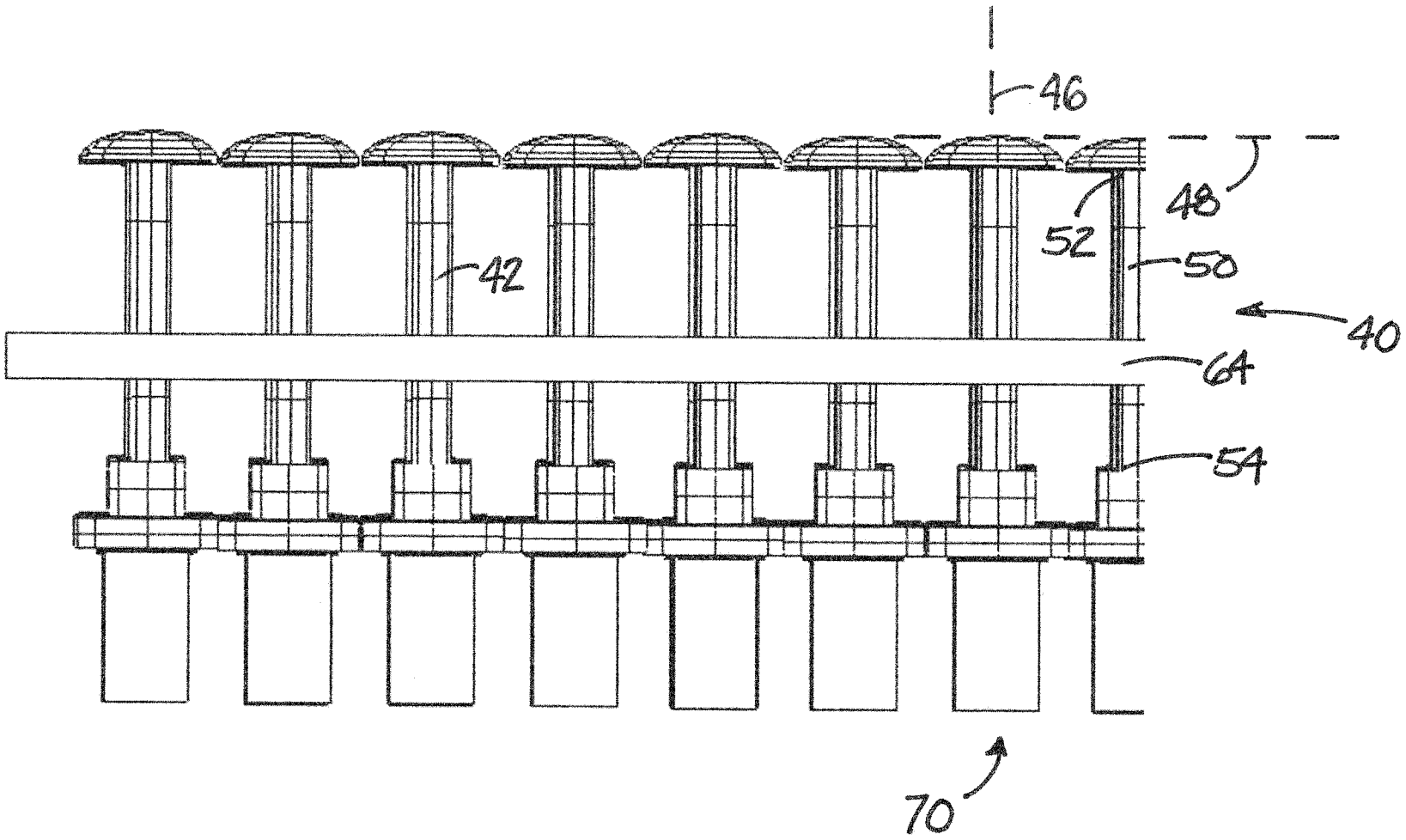
FIG. 5 is a schematic side view of the support assembly with the covering removed to show detail of the support assembly in the neutral position.
Figure 6:
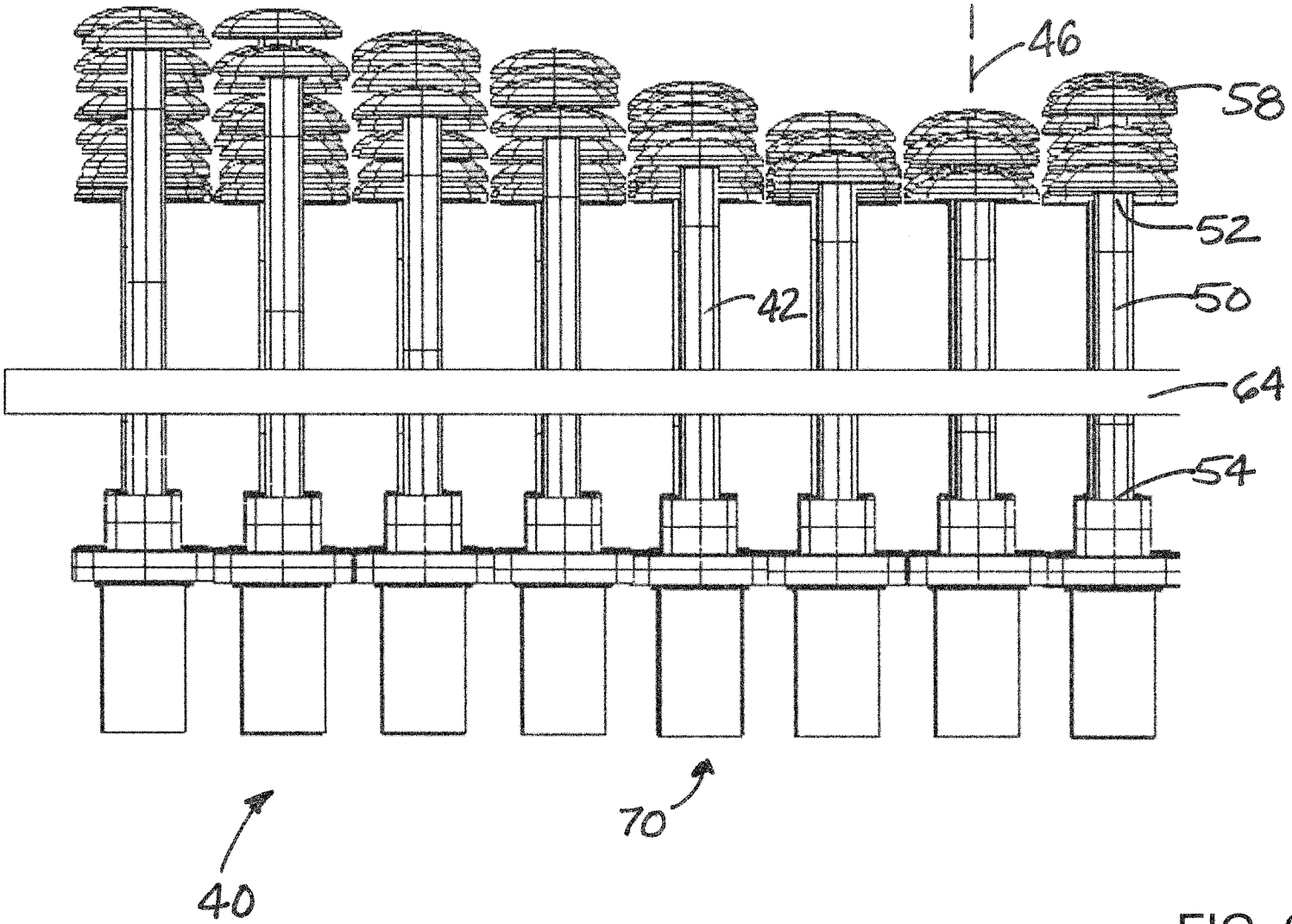
FIG. 6 is a schematic side view of the support assembly with the covering removed to show detail of the support assembly in the raised position.
Figure 7:
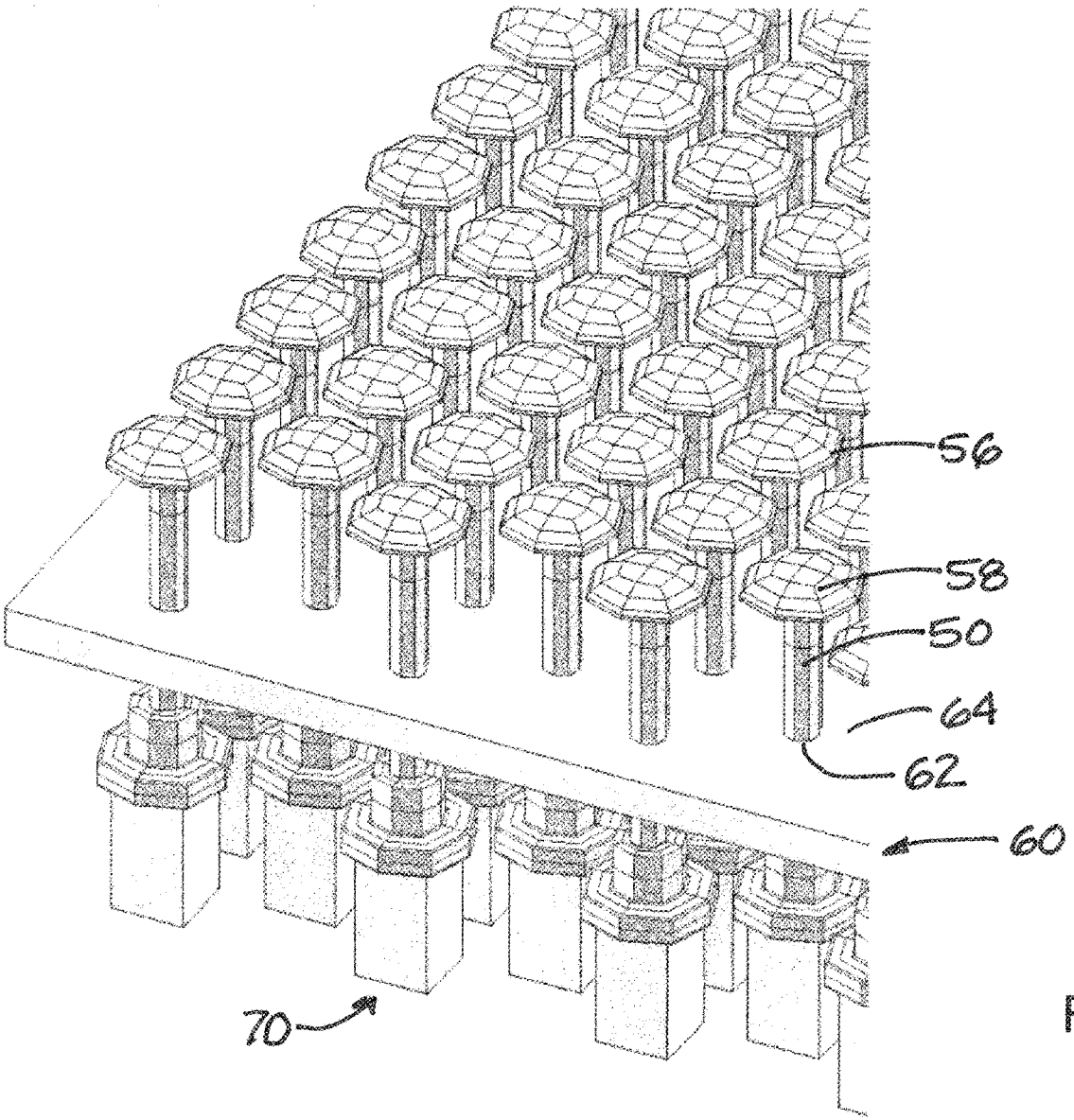
FIG. 7 is a schematic perspective view of the support assembly with the covering removed to show detail of the support assembly with the positioning elements in an optional arrangement.
Figure 8:
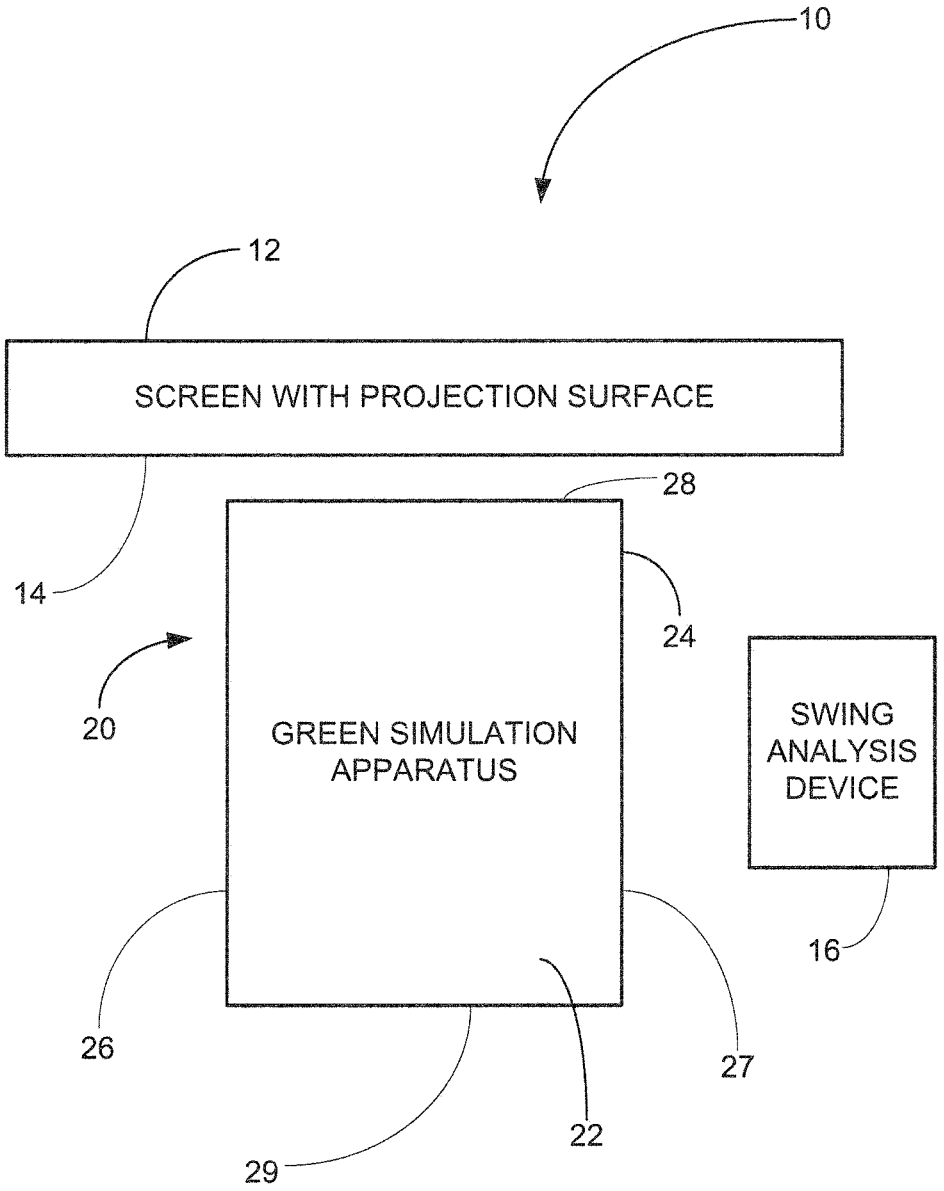
FIG. 8 is a schematic diagram of the golf simulation system according to an illustrative embodiment.

The reference plane 48 may be defined by the upper ends 44 of the positioning elements when those elements are in a neutral position (see FIG. 5). The neutral position may be the lowermost positioning of the vertical travel of the positioning elements, hut this is not required. The base condition of the covering 30 may generally correspond with the positioning elements 42 being in the neutral position.

The positioning elements 42 may have a plurality of raised positions that are located vertically higher than the neutral position, and in some embodiments the positions of the elements, and the upper ends thereof, may be infinitely variable between the neutral position and a position of maximum vertical elevation of the upper end. The vertical positions of a positioning element may generally be independent of the other positioning elements. Suitable ranges of the distance of vertical movement may vary from 0 inches to approximately 24 inches, although greater or lesser ranges may be utilized, including ranges of 0 inches to 48 inches, 72 inches or even more. In some embodiments, a range of movement of 0 inches to approximately 12 inches may be employed.

In the illustrative embodiments, each positioning element 42 may comprise a pin 50 which has a top end 52 and a bottom end 54, and the pin may have a length between the top and bottom ends. The pin may have a maximum width which may be measured perpendicular to the longitudinal axis 46 of the element 42. In some of the most preferred embodiments, the outer surface of the pin may be substantially cylindrical in shape, although cross sectional shapes other than circular may be employed, particularly where resistance to rotation of the pin is desired. Each positioning element 42 may also comprise a head 56 that is mounted on the pin 50.

The head may be located on the top end 52 of the pin, and the head may define at least a portion of the upper end 44 of the positioning element. In some of the most preferred embodiments, the head 56 of a positioning element is unconnected to the heads of the adjacent positioning elements such that the positioning elements are able to move substantially independently of each other, although attachment to the covering (if employed) may produce some degree of constraint. In some of the most preferred embodiments, the head may have a substantially circular perimeter shape when viewed from above, any rounded shape may be employed, including oval shapes. Other perimeter shapes, including polygonal shapes when viewed from above may also be used.

The head 56 may have a top surface 58, and in some embodiments the top surface has a convex shape which may be advantageous and may give the overall element a general mushroom-shape. The convexity of the top surface is not critical, as the top surface may also, for example, be substantially flat. The head 56 may have a maximum width which may be measured perpendicular to the longitudinal axis 46 of the element 42. The maximum width of the head may be uniform among all of the elements, although variation in dimension may be employed.

The maximum width of the head may be greater than the maximum width of the pin such that the head is enlarged in width with respect to the pin and presents a broader top surface than would the top end of the pin alone. The range of maximum widths for the heads may vary and may range from approximately ¼ inch to approximately 6 inches which is believed to provide the greatest variability in the contour of the upper surface of the covering. In the array of positioning elements, the head 56 of one positioning element may be spaced from the head of an adjacent positioning element such that there is some separation of the heads, which may be advantageous but is not critical A closest distance of the spacing between the adjacent heads may be about equal to or somewhat less than the maximum width of the head. The size of the maximum width of the head 56 and the spacing distance between the heads may be varied independently of each other to provide a desirable degree of contourability while still a suitable degree of support for the covering and a user standing on the covering. The spacing distance between heads may range from approximately 1/32 inch to approximately 12 inches, although spacings greater than these may be employed in some embodiments, the covering 30 may be fixed or attached to some or all of the positioning elements 42 to cause the portion of the covering above an element 42 to move with the movement of the element 42. The covering may be secured to the element 42, such as the top surface 58 of the head 56, in any suitable manner, such as by bonding (using, for example, an adhesive) or by mechanical fastening.

Attachment of the covering to some of all of the heads may constrain the movement of adjacent positioning elements to some degree as the covering may not be able to conform to substantial differences in vertical elevation between adjacent positioning elements. The relative flexibility and stretchability or elasticity of the material forming the covering may have an effect on the maximum difference in vertical elevation between adjacent elements 42. In some embodiments, the covering 30 may not be physically attached to some or all of the positioning elements, and the weight of the covering may be sufficient to keep the portion of the covering above an element 42 in close proximity to, if not contact with, the top surface 58 of the head 56.

The support assembly 40 may further include a guide 60 that 1 s configured to guide the positioning elements 42 as the elements move. In some embodiments, the guide 60 has a guide aperture 62 for receiving each of the positioning elements. The positioning element 42 may be movable, and in some cases slidable, through the guide aperture 62. The guide aperture 62 may have a substantially vertical axis, and the aperture may be shaped and sized for a somewhat snug relationship with the pin to facilitate vertical movement without undue lateral movement. The guide 60 may have a plurality of the guide apertures, and the apertures may be substantially uniformly spaced from adjacent guide apertures formed in the guide. In the illustrative embodiments, the guide 60 may comprise at least one guide plate 64 with the guide apertures being formed in the plate 64. Other suitable configurations of the guide may be employed, such as, for example, multiple plates in a substantially parallel relationship, or a plurality of sleeves that each receive the pin of one of the elements.

The support assembly 40 may also comprise a movement actuator 70 that is configured to move at least one of the positioning elements 42. In some embodiments, one of the movement actuators 70 acts on each positioning element such that each positioning element is movable independently of other positioning elements. The movement actuator 70 may be positioned below the reference plane, and may be located below the guide 60, The movement actuator 70 may act on the bottom end 54 of the pin 50, or a bottom portion of the pin. The movement actuator 70 may be any suitable actuator that is capable of moving a pin vertically. Examples of suitable technology may employ pneumatics, hydraulics, magnetics, or mechanical action. Structures employing these technologies include, for example, piston and cylinder structures and linear actuators. The activation of the movement actuators may be controlled manually by a user, or may be controlled by a computerized system that controls the movement actuators automatically to produce a contouring that has been programmed into the system.

A golf hole or cup may be provided for the apparatus 20 in various ways. In some embodiments, the cup may be formed by a depress ion in the upper surface of the covering by dropping the position of the movable positioning elements at the desired location of the cup. In some embodiments, a hole may be formed in the covering (optionally with a cup extending downwardly therefrom) at a location that is relatively fixed on the upper surface, and the upper surface may thus be contoured around the hole and cup.

Using the disclosed green simulation apparatus, the user surface may be contoured in a manner that is able to produce an area of the upper surface that is raised to a vertical level that is relatively higher than areas of the upper surface that surround the raised area. This differentiates the apparatus of the disclosure from other apparatus that simply tilt the upper surface or form a depressed "va1ley" between raised "ridges."

While the disclosed apparatus is capable of forming these relatively simpler types of contours in the upper surface, it is not limited to them and is also capable of forming more complex contours such as the aforementioned raised areas of the upper surface surrounded depressed areas that can more accurately represent real world green contours. Further, the contouring of the upper surface may be controlled, through actuation of the movement actuators in an individual manner, by a computerized system that may replicate the contours of greens of actual golf courses.

In some embodiments, the movable positioning elements may be formed of structures that include a female cylinder 76 or sleeve that includes the top end of the element and defines a channel into which extends a male post 78 forming the bottom end of the element. In some embodiments (see FIG. 10), the exterior surface of the post 78 and interior surface of the channel in the cylinder 76 may be complementarily threaded so that the threads engage. The post may be mounted to permit rotation about a vertical axis, and the post may be rotated to cause raising and lowering of the sleeve, and the top end located thereon. The post may be rotated by a motor or by any suitable mechanical, hydraulic, pneumatic, or other, means.

The motor may be operated or controlled to raise or lower the top end and the portion of the covering located above the positioning element. Optionally, other means may be employed to cause the cylinder to move with respect to the post.

In some further embodiments, the moveable positioning elements may comprise pins that are relatively free floating within extreme limits that have lower ends that are exposed to contact a contoured substrate that correlates in some manner to the desired contour of the upper surface of the covering.

The substrate may have a contoured upper face that is positioned below the lower ends of the pins, and movement of the substrate upwardly to contact the lower ends of the pins tends to raise the pins to a degree that varies with the contour of the upper face at the location that the lower end contacts the face. The pins may thus telegraph the contour of the upper face of the substrate to the covering, and the upper surface of the covering.

Figure 9:
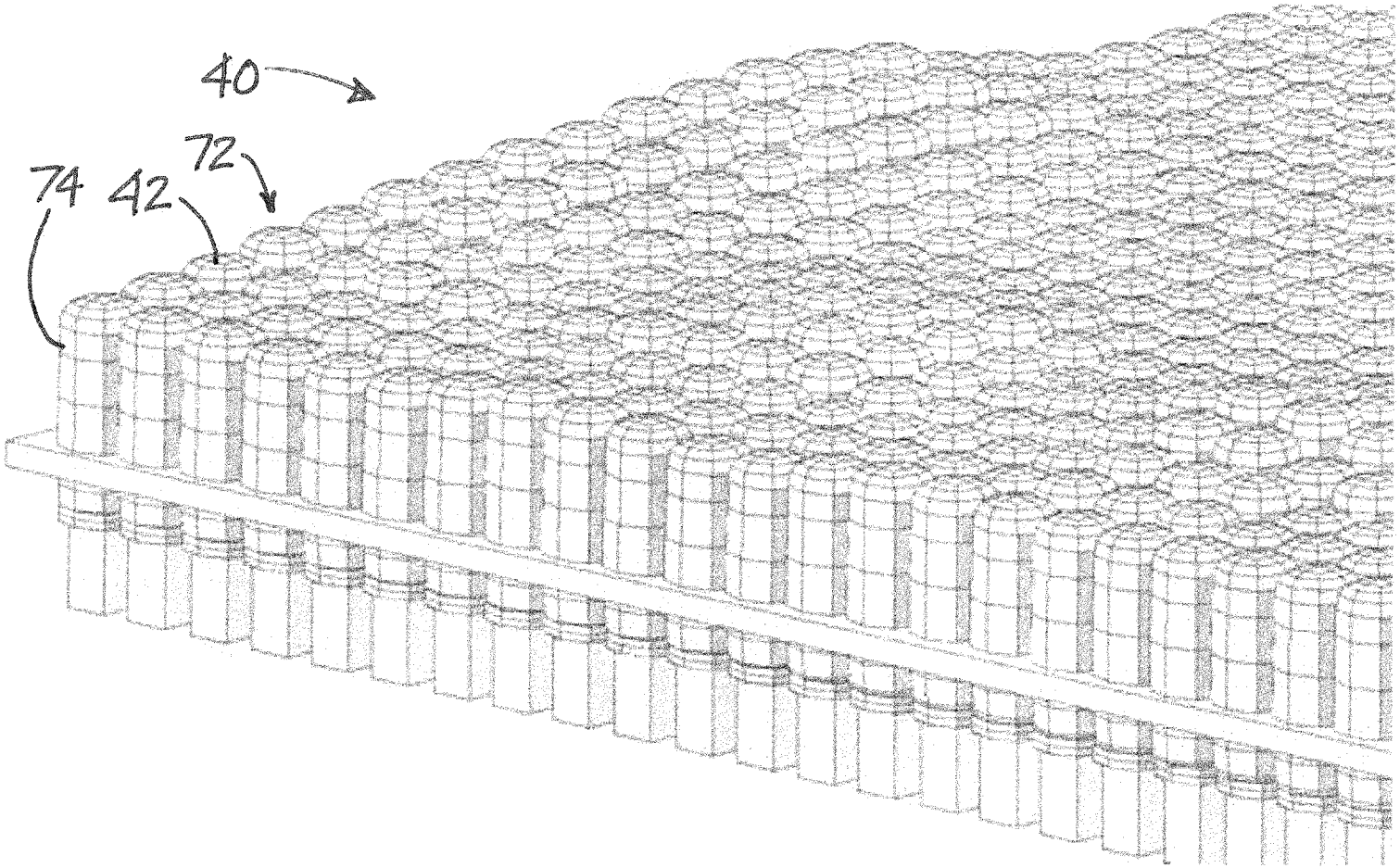
FIG. 9 is a schematic perspective view of an embodiment of the support assembly with the covering removed to show detail of the positioning elements, which defined a plurality of chambers for supporting the covering.
Figure 10:
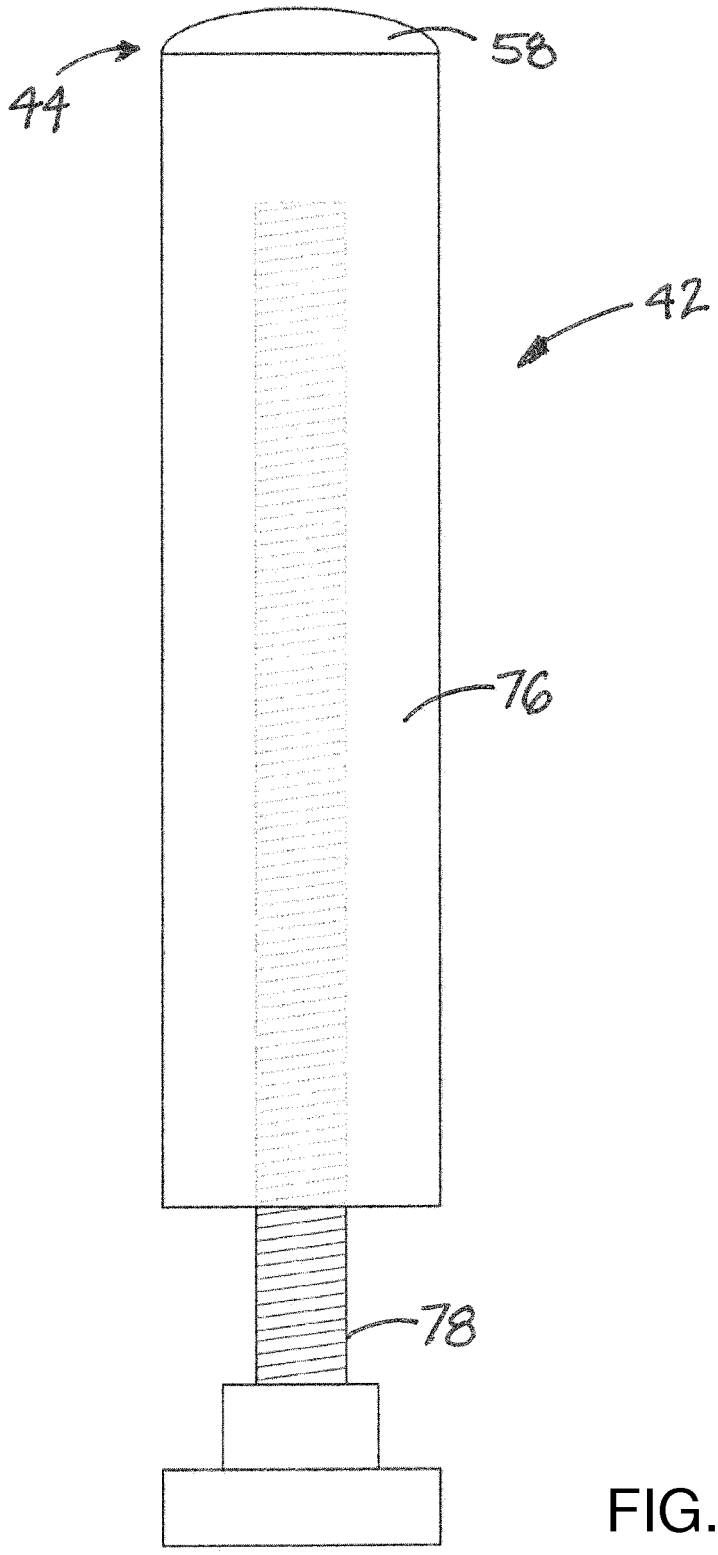
FIG. 10 is a schematic side view of one embodiment of a positioning element utilizing a cylinder and post arrangement, according to an illustrative embodiment.
Figure 11:
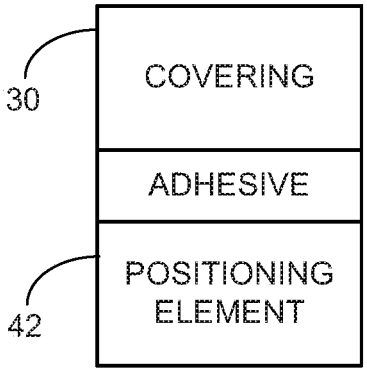
FIG. 11 is a schematic diagram of an illustrative relationship between the covering and one of the positioning elements.
Figure 12:
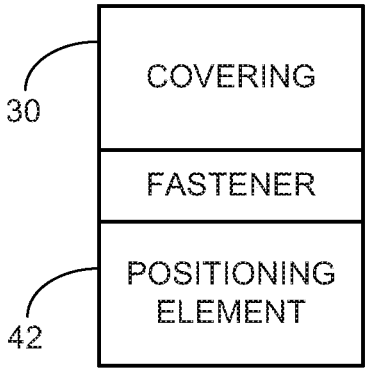
FIG. 12 is a schematic diagram of another illustrative relationship between the covering and one of the positioning elements.

In some still further embodiments, the plurality of movable positioning elements may comprise a plurality of chambers 72 for rece1vmg a fluid such as a liquid or a gas that is moved into and out of the chamber to expand or contract the volume of the chamber (see FIG. 9).

The chamber may be defined by a flexible wall 74, such as a bag or balloon or sack that contains without leakage the fluid utilized which moves into and out of the chamber. The movement of the fluid into and out of the chambers may be individually controlled such that the chambers may be filled to different degrees to provide different levels of expansion and vertical lift of the covering positioned above the chamber.

In some optional embodiments, the covering 40 may be omitted and the upper end 44 of the positioning elements may collectively form the upper surface 22 of the apparatus, as if the upper end of each of the elements was a "pixel" of the upper surface.

General Interpretive Principles for the Present Disclosure

Various aspects of the novel systems, apparatuses, and methods are described more fully hereinafter with reference to the accompanying drawings. The teachings disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the novel systems, apparatuses, and methods disclosed herein, whether implemented independently of or combined with any other aspect of the disclosure. For example, a system or an apparatus may be implemented, or a method may be practiced using any one or more of the aspects set forth herein. In addition, the scope of the disclosure is intended to cover such a system, apparatus or method which is practiced using other structure, functionality, or structure and functionality in addition to or other than the various aspects of the disclosure set forth herein. It should be understood that any aspect disclosed herein may be set forth in one or more elements of a claim. Although some benefits and advantages of the preferred aspects are mentioned, the scope of the disclosure is not intended to be limited to particular benefits, uses, or objectives. The detailed description and drawings are merely illustrative of the disclosure rather than limiting, the scope of the disclosure being defined by the appended claims and equivalents thereof.

With respect to the use of plural vs. singular terms herein, those having skill in the art can translate from the plural to the singular and/or from the singular to the plural as is appropriate to the context and/or application. The various singular/plural permutations may be expressly set forth herein for sake of clarity.

When describing an absolute value of a characteristic or property of a thing or act described herein, the terms "substantial," "substantially," "essentially," "approximately," and/or other terms or phrases of degree may be used without the specific recitation of a numerical range. When applied to a characteristic or property of a thing or act described herein, these terms refer to a range of the characteristic or property that is consistent with providing a desired function associated with that characteristic or property.

In those cases where a single numerical value is given for a characteristic or property, it is intended to be interpreted as at least covering deviations of that value within one significant digit of the numerical value given.

If a numerical value or range of numerical values is provided to define a characteristic or property of a thing or act described herein, whether or not the value or range is qualified with a term of degree, a specific method of measuring the characteristic or property may be defined herein as well. In the event no specific method of measuring the characteristic or property is defined herein, and there are different generally accepted methods of measurement for the characteristic or property, then the measurement method should be interpreted as the method of measurement that would most likely be adopted by one of ordinary skill in the art given the description and context of the characteristic or property. In the further event there is more than one method of measurement that is equally likely to be adopted by one of ordinary skill in the art to measure the characteristic or property, the value or range of values should be interpreted as being met regardless of which method of measurement is chosen.

It will be understood by those within the art that terms used herein, and especially in the appended claims (e.g., bodies of the appended claims) are intended as "open" terms unless specifically indicated otherwise (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

In those instances where a convention analogous to "at least one of A, B, and C" is used, such a construction would include systems that have A alone, B alone, C alone, A and B together without C, A and C together without B, B and C together without A, as well as A, B, and C together. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include A without B, B without A, as well as A and B together."

Various modifications to the implementations described in this disclosure can be readily apparent to those skilled in the art, and generic principles defined herein can be applied to other implementations without departing from the spirit or scope of this disclosure. Thus, the disclosure is not intended to be limited to the implementations shown herein but is to be accorded the widest scope consistent with the claims, the principles and the novel features disclosed herein. The word "exemplary" is used exclusively herein to mean "serving as an example, instance, or illustration." Any implementation described herein as "exemplary" is not necessarily to be construed as preferred or advantageous over other implementations.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features can be described above as acting in certain combinations and even initially claimed as such, one or more features from a claimed combination can in some cases be excised from the combination, and the claimed combination can be directed to a sub-combination or variation of a sub-combination.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

What is claimed is:

1. An apparatus having a configurable upper surface with a changeable contour, the apparatus comprising:

a covering forming the upper surface, the covering being flexible such that the covering is movable between a base condition in which the upper surface has a substantially planar configuration and a contoured condition in which the upper surface has a contoured configuration; and a covering support assembly configured to support the covering in the base condition and the contoured condition, the support assembly comprising:

a plurality of movable positioning elements having the covering resting thereon, the plurality of positioning elements being positioned in an array below the covering, the positioning elements each having an upper end comprising a head contacting a portion of the covering, each head having a maximum width and being spaced from adjacent heads by a closest spacing which is less than the maximum width of the head, the positioning elements being movable to adjust a vertical position of the head of the upper end of the positioning element contacting the covering to create contours; and a movement actuator configured to move at least one of the positioning elements, one of the movement actuators acting on at least one of the positioning elements such that the positioning elements are movable independently of other positioning elements.

2. The apparatus of claim 1, wherein the upper end of the positioning element is attached to the covering.

3. The apparatus of claim 1, wherein the upper end of the positioning element is unattached to the covering.

4. The apparatus of claim 1, wherein the covering is elastomerically stretchable.

5. The apparatus of claim 1, wherein each of the positioning elements comprises:

a pin having a top end and a bottom end, wherein the head of the positioning element is mounted on the top end of the pin.

6. The apparatus of claim 5, wherein the head of one positioning element is unconnected to the heads of adjacent positioning elements.

7. The apparatus of claim 5, wherein the head has a top surface with a convex shape.

8. The apparatus of claim 5 wherein maximum of the head is greater than a maximum width of the pin.

9. The apparatus of claim 1, wherein the positioning elements are elongated with a longitudinal axis that is substantially vertically oriented.

10. The apparatus of claim 1, wherein the upper ends of the positioning elements are moveable with respect to a reference plane that is defined by upper ends of the positioning elements being in a neutral position, the positioning elements having a plurality of raised positions located vertically higher than the neutral position.

11. The apparatus of claim 1, wherein the covering support assembly includes a guide configured to guide the positioning elements as the elements move.

12. A golf simulation system comprising:

a screen with a projection surface;

a ball path analysis device configured to predict a path of a ball struck by a club of a user; and a green simulation apparatus having a configurable upper surface with a changeable contour, the apparatus comprising:

a covering forming the upper surface, the covering being flexible such that the covering is movable between a base condition in which the upper surface has a substantially planar configuration and a contoured condition in which the upper surface has a contoured configuration; and a covering support assembly configured to support the covering in the base condition and the contoured condition, the support assembly comprising:

a plurality of movable positioning elements having the covering resting thereon, the plurality of positioning elements being positioned in an array below the covering, the positioning elements each having an upper end comprising a head contacting a portion of the covering, each head having a maximum width and being spaced from adjacent heads by a closest spacing which is less than the maximum width of the head, the positioning elements being movable to adjust a vertical position of the upper end of the positioning element contacting the covering; and a movement actuator configured to move at least one of the positioning elements, one of the movement actuators acting on one of the positioning elements such that each of the positioning elements is movable independently of other positioning elements.

13. The system of claim 12, wherein each of the positioning element comprises:

a pin having a top end and a bottom end, wherein the head of the positioning element is mounted on the top end of the pin.

14. The system of claim 13, wherein the head of one positioning element is unconnected to the heads of adjacent positioning elements.

15. The system of claim 12, wherein the upper ends of the positioning elements are moveable with respect to a reference plane that is defined by upper ends of the positioning elements being in a neutral position, the positioning elements having a plurality of raised positions located vertically higher than the neutral position.

* * * * *